US006269506B1

(12) United States Patent
Hollatz et al.

(10) Patent No.: US 6,269,506 B1
(45) Date of Patent: Aug. 7, 2001

(54) METHOD AND ARRANGEMENT FOR COMPUTER-ASSISTED DETERMINATION OF CLUSTERS FOR THE RECOGNITION OF FOAMING IN A WASHING MACHINE AS WELL AS METHOD AND ARRANGEMENT FOR RECOGNIZING FOAMING IN A WASHING MACHINE

(75) Inventors: Juergen Hollatz; Thomas Runkler, both of Munich (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/409,001

(22) Filed: Sep. 29, 1999

(30) Foreign Application Priority Data

Sep. 30, 1998 (DE) ..... 19844949

(51) Int. Cl.[7] ..... D06F 33/02

(52) U.S. Cl. ..... 8/158; 8/159; 68/12.02; 68/12.03; 68/12.05

(58) Field of Search ..... 8/158, 159; 68/12.01, 68/12.02, 12.03, 12.05

(56) References Cited

U.S. PATENT DOCUMENTS 4,410,329 * 10/1983 Blevins et al. ..... 8/158
5,603,233 2/1997 Erickson et al. .
5,687,440 * 11/1997 Min et al. ..... 8/158
5,768,730 * 6/1998 Matsumoto et al. ..... 8/159
5,768,731 * 6/1998 Do ..... 8/159

FOREIGN PATENT DOCUMENTS 196 06 769 A1 8/1997 (DE) .

OTHER PUBLICATIONS

M. Liphard and A. Giza, Einfluss des Schaums auf die Waschleistung unter Berücksichtigung neuer elektronischer Waschmaschinensteuerungen ("fuzzy logic"), Tenside Surf. Det. 34 (1997) 6, pp. 410–416.
Jürgen Hollatz and Thomas A. Runkler, Datenanalyse und Regelerzeugung mit Fuzzy–Clustering, Fuzzy–News.
James C. Bezdek et al., Detection and Characterization of Cluster Substructure II, Fuzzy c–Varieties and Convex Combinations Thereof, SIAM Journal on Applied Mathematics, vol. 40, No. 2, pp. 358–372, 1981.

* cited by examiner

*Primary Examiner*—Philip R. Coe
(74) *Attorney, Agent, or Firm*—Schiff Hardin & Waite

(57) ABSTRACT

A method and arrangement for computer-assisted determination of clusters recognizes foaming in a washing machine. The following quantities are measured during a washing process in the washing machine; a pressure in the washing machine, a temperature in the washing machine, and an amount of water in the washing machine. Application vectors are formed from the measured quantities, and fuzzy affiliation values for predetermined clusters are identified for the application vectors. A foam formation is recognized based on the fuzzy affiliation values.

18 Claims, 3 Drawing Sheets

METHOD AND ARRANGEMENT FOR COMPUTER-ASSISTED DETERMINATION OF CLUSTERS FOR THE RECOGNITION OF FOAMING IN A WASHING MACHINE AS WELL AS METHOD AND ARRANGEMENT FOR RECOGNIZING FOAMING IN A WASHING MACHINE

BACKGROUND OF THE INVENTION

The prior art of N. Liphard and A. Giza, Einfulβ des Schaums auf die Waschleistung unter Berücksichtigung neuer elektronischer Waschmaschinensteuerung ("Fuzzylogik"), Tensid Surfacetants detergents, Volume 34, No. 6, Carl Hanser Verlag, Muinchen, pages 410–416, 1997, teaches that a large generation of foam when washing textiles in a washing machine can lead to the washing machine foaming over. As a result, the necessary mechanical processing of the textiles is reduced, and non-optimum cleaning performance results. Also, this prior art reference discloses the principle of fuzzy logic in the framework of electronic washing machine control.

For improving the cleaning performance, it is necessary to quickly recognize an intensified foaming or to predict it and undertake suitable counter-measures by regulating the washing procedure in a washing machine. However, this requires recognizing variables whose interaction critically influence the foam formation during a washing procedure. In the prior art it is not known which influencing variables are to be assigned critical significance.

The two prior art references of J. Hollatz and T. Runkler, Datenanalyse und Regelerzeugung mit Fuzzy-Clustering, Fuzzy-Systeme in Theorie und Anwendungen, in: Hellendoorn Adamy Prehm Wegmann and Linzenkirchner, Chapter 5.6, Siemens AG, Nurnberg, 1997; and J. C. Bezdek et al, Detection and Characterization of Cluster Substructure, II. Fuzzy c Varieties and Convex Combinations thereof SIAM Journal on Applied Mathematics, Volume 40, No. 2, Page 358–370, 1981, disclose what is referred to as a fuzzy clustering method for data analysis and control generation. Within the framework of fuzzy clustering, c clusters and corresponding affiliations of data vectors $X_k$ are identified such that data vectors that lie in a data space close to a cluster exhibit an optimally high affiliation and data vectors $X_k$ lying at a greater distance from the cluster exhibit an optimally low affiliation to the respective cluster. This is achieved by minimization of a sum of the quadratic, Euclidean distances $di_i^2{}_k$ weighted with affiliations $u_i^m{}_k$. That is, a set X of data vectors $x_k$ $X=(x_1, x_2. . . , x_k. . . , x_n)$ are grouped in c clusters (subsets of the set of data vectors).

The clusters are described by an affiliation matrix U that comprises c rows and n columns. Each element $u_{ik}$ of the affiliation matrix U comprises a value within the interval [0, 1 ] and describes an affiliation of the data vector $x_k$ to the $i^{th}$ cluster. The sum of the affiliations of the data vectors $x_k$ in the c clusters must satisfy the following rule:

$$\sum_{i=1}^{c} u_{ik} = 1 \quad \forall k = 1 \ldots n. \tag{1}$$

A cluster must contain at least one element, so that the following applies:

$$\sum_{k=1}^{n} u_{ik} > 0 \quad \forall k = 1 \ldots c. \tag{2}$$

The cost function $J_m$ of the affiliation values is formed according to the following rule:

$$J_m = \sum_{i=1}^{c} \sum_{k=1}^{n} u_{ik}^m \cdot d_{ik}^2. \tag{3}$$

A distance $d_{ik}$ is formed according to the following rule:

$$d_{ik} = \|\underline{x}_k - \underline{v}_i\|_A = \sqrt{(\underline{x}_k - \underline{v}_i)^T \cdot \underline{A} \cdot (\underline{x}_k - \underline{v}_i)}\,. \tag{4}$$

A prescribable, induced norm of the internal product according to Rule (4) is referenced A, this usually being established by the identity matrix (Euclidean distance). The minimization of the cost function $J_m$ ensues by utilization of what is referred to as a Picard iteration.

Affiliation values $u_{ik}$ and cluster centers $v_i$ are successively formed according to the following rules:

$$u_{ik} = \frac{1}{\sum_{j=1}^{c} \left(\frac{d_{ik}}{d_{jk}}\right)^{\frac{2}{m-1}}}, \tag{5}$$

$$\underline{v}_i = \frac{\sum_{k=1}^{n} u_{ik}^m \cdot \underline{x}_k}{\sum_{k=1}^{n} u_{ik}^m} \tag{6}$$

The determination of the affiliation values $u_{ik}$ and of the cluster centers $v_i$ is repeated until a defined plurality of iterations has been implemented or until a change of the affiliation values $u_{ik}$ and/or until a change of the cluster centers $v_i$ lies below a predetermined threshold. The clusters in this above-described method, also referred to as fuzzy C-means clustering, are described by their cluster centers $v_i$.

What are referred to as prototypes of the clusters are unsharp points in this case. Various prototypes are also known from the prior art references of J. Hollatz and T. Runkler, Datenanalyse und Regelerzeugung mit Fuzzy-Clustering, Fuzzy-Systeme in Theorie und Anwendungen, in: Hellendoorn Adamy Prehm Wegmann and Linzenkirchner, Chapter 5.6, Siemens AG, Nurnberg, 1997; and J. C. Bezdek et al, Detection and Characterization of Cluster Substructure, II. Fuzzy c Varieties and Convex Combinations thereof SIAM Journal on Applied Mathematics, Volume 40, No. 2, Page 358–370,1981. What is to be understood by a prototype is a set of parameters with which the location and the shape of a cluster is described.

For example, a clustering within the framework of a linear model is implemented such that clusters are linear subspaces. A linear model Vr can be defined according to the following rule:

$$Vr(\underline{v}, \underline{s}, \ldots, \underline{s}_r) = \left\{ \underline{y} \in \mathbb{R}^p | \underline{y} = \underline{v} + \sum_{j=1}^{r} \underline{t}_j \underline{s}_j, \underline{t}_j \in \mathbb{R} \right\} \tag{7}$$

whereby v references a point within the linear sub-space and $s_{ij}$ respectively references a direction within the sub-space.

The dimension of a feature space $R^p$ is referenced p and a dimension of the sub-space $R^r$ is referenced r. In general, a distance $d_{ik}$ between a data vector $x_k$ and a cluster ($v_i$, $s_{i1}$,..., $s_{ir}$) is defined according to:

$$d_{ik} = \sqrt{\|x_k - \underline{v}_i\|_A^2 - \sum_{j=1}^{r} \left((x_k - \underline{v}_i)^T \cdot \underline{A} \cdot \underline{s}_{ij}\right)^2} \tag{8}$$

with $$\|X_k - V_i\|_A = \sqrt{(X_k - V_i)^T \cdot A \cdot (X_k - V_i)}. \tag{9}$$

The cluster center $v_i$ is respectively calculated according to Rule [6], and the directions $s_{ij}$ respectively describe Eigen-vectors of the greatest Eigen-value within a fuzzy scatter matrix $S_{iA}$ that is formed according to the following rule:

$$\underline{S}_{iA} = \underline{A}^{\frac{1}{2}} \cdot \left[\sum_{k=1}^{n} u_{ik} (\underline{x}_k - \underline{v}_i) \cdot (\underline{x}_k - \underline{v}_i)^T\right] \cdot \underline{A}^{\frac{1}{2}}. \tag{10}$$

When the prototype is established by an elliptical prototype (fuzzy c-elliptotypes) then the distance dik is formed according to the following rule:

$$d_{ik} = \sqrt{\|\underline{x}_k - \underline{v}_i\|_A^2 - \sum_{j=1}^{r} \left((x_k - \underline{v}_i)^T \cdot \underline{A} \cdot s_{ij}\right)^2} \tag{11}$$

SUMMARY OF THE INVENTION

It is an object of the present invention to provide methods and arrangements with which recognition of foam formation is enabled without requiring additional sensors in a washing machine.

In general terms the present invention is a method for computer-assisted determination of clusters for recognizing foam formation in a washing machine. In the method the following quantities are measured during a washing process; a pressure in the washing machine, a temperature prevailing in the washing machine, and an amount of water present in the washing machine. Training data vectors are formed from the measured quantities. Depending on the training data vectors, clusters are determined which indicated if a foam formation is to be anticipated for a set of measured quantities.

The present invention is also a method for recognizing foam formation in a washing machine. In the method the following quantities are measured during a washing process; a pressure in the washing machine, a temperature in the washing machine, and an amount of water in the washing machine. Application vectors are formed from the measured quantities. Fuzzy affiliation values of the application vectors for predetermined clusters are identified for the application vectors. A foam formation is recognized dependent on the fuzzy affiliation values.

The present invention is further an arrangement for determining clusters for recognizing foam formation in a washing machine. A processor is configured such that the following quantities are measured during a washing process; a pressure in the washing machine, a temperature in the washing machine, and an amount of water in the washing machine. Training data vectors are formed from the measured quantities. Depending on the training data vectors, clusters are identified which indicate if a foam formation is to be anticipated for a set of measured quantities.

The present invention is also an arrangement for recognizing foam formation in a washing machine comprises a processor that is configured such that the following quantities are measured during a washing process; a pressure in the washing machine, a temperature in the washing machine, and an amount of water present in the washing machine. The processor is also configured such that application vectors are formed from the measured quantities, and fuzzy affiliation values of the application vectors for predetermined clusters are identified for the application vectors. A foam formation is recognized depending on the fuzzy affiliation values.

The invention achieves a significantly more economical and faster recognition of foam formation within a washing machine than prior art methods. This became particularly possible due to the perception that the foam formation is essentially dependent on the quantities of temperature, pressure, amount of water in the washing machine.

Advantageous developments of the present invention are as follows.

A method based on a fuzzy clustering method is preferably utilized for determining the clusters. In this way, a simple, automatic identification of the clusters is possible on the basis of the training data vectors. Dependent on the recognition result of the foaming, a control with which an intervention is made in the foam formation in the washing machine is preferably undertaken.

The control preferably ensues such that at least one of the following actions is implemented: water is supplied to the washing machine, the temperature prevailing in the washing machine is lowered, cycle with which a changing speed and/or rotational direction of a drum rotating in the washing machine is varied, and a de-foaming material is supplied to the washing machine. What is to be understood by a de-foaming material is a substance with which the foam formation within the washing machine is reduced. Thus, for example, an oil-containing additive bonds the tensides in the water and thereby inhibits the foam formation.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
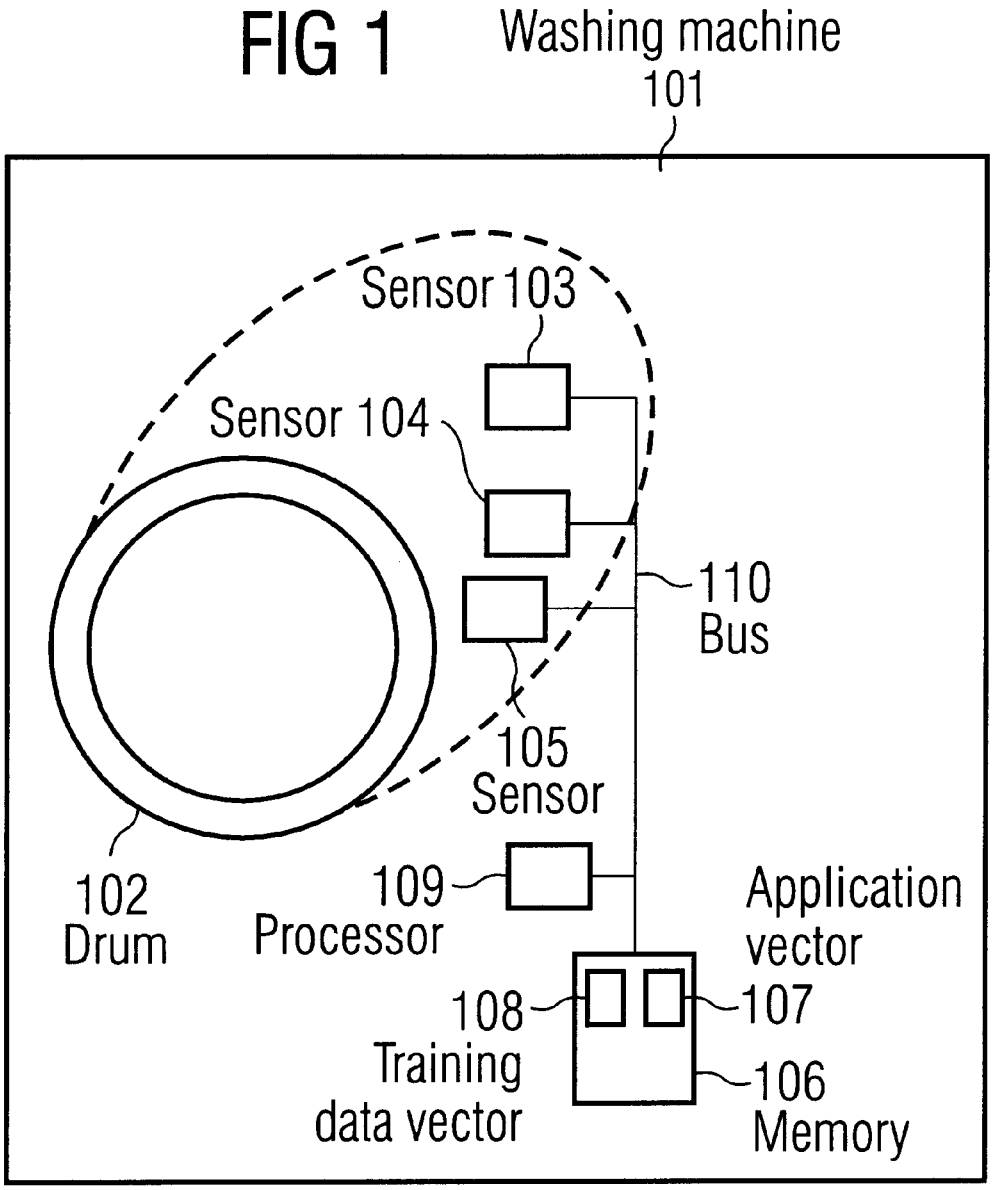
FIG. 1 is a diagram of a washing machine with sensors with reference whereto the principle of the recognition of the foam formation is graphically shown.

FIG. 1 shows a washing machine 101 with a washing machine drum 102. A first sensor 103 for measuring the temperature prevailing in the washing machine 101, a second sensor 104 for measuring the pressure prevailing in the washing machine 101 as well as a third sensor 105 for measuring the water contained in the washing machine drum 102 are provided in the washing machine 101.

The sensors 103, 104 and 105 are connected to a memory 106 via a bus 110. In a time interval of one second, the sensors 103, 104, 105 measure the quantities temperature T, pressure P and water amount W within the washing machine 101 and these are stored in the memory 106. The quantities temperature T, pressure P and water amount W, respectively measured at a point in time, form a training data vector 108 or an application vector 107, dependent on whether the method is utilized in a training phase or in an application phase. The training data vectors 108 and the application vectors 107 are stored in the memory 106. A processor 109 is also connected to the bus 110, the processor 109 being configured such that the method steps described below can be implemented.

Figure 2:
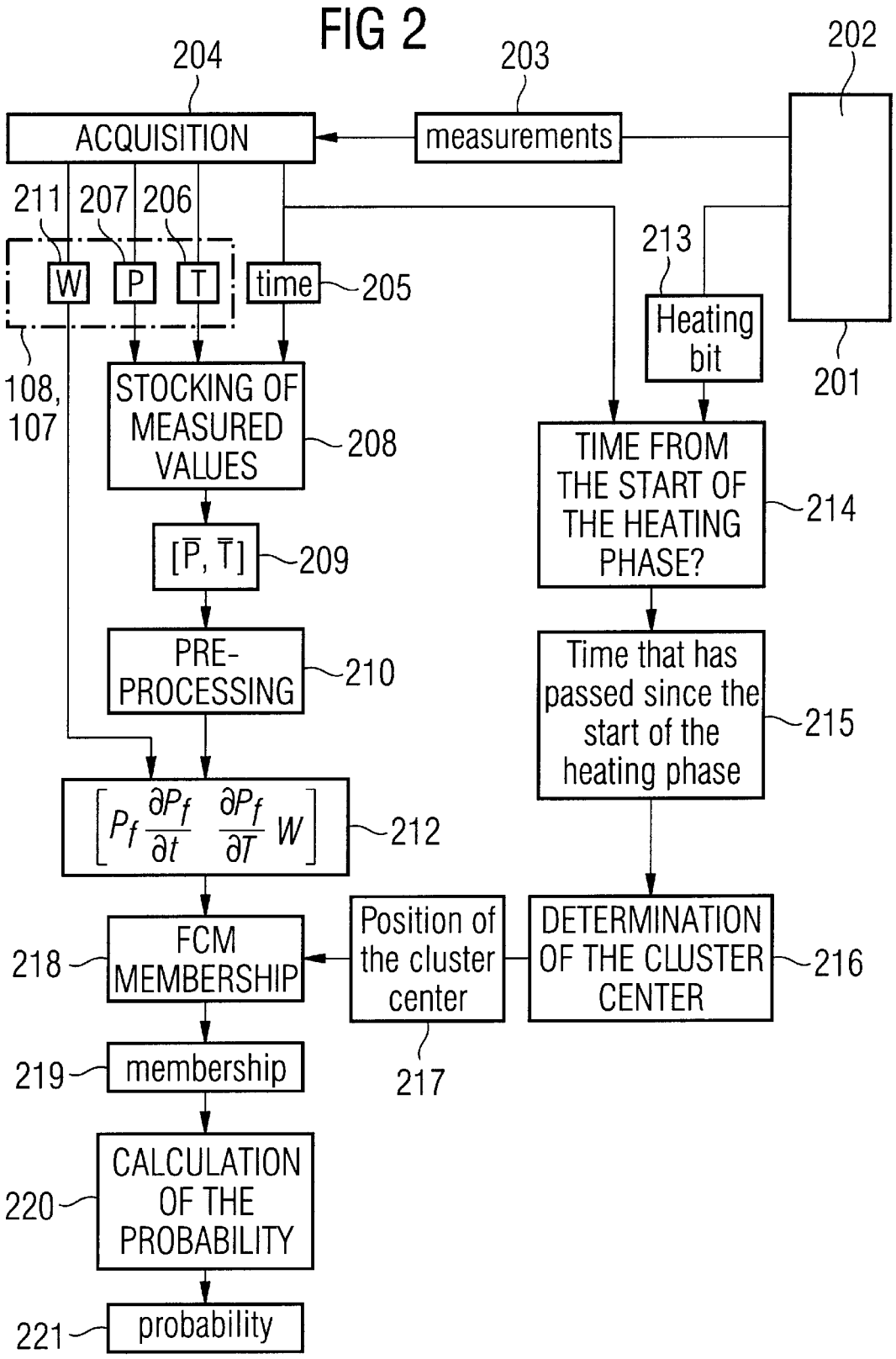
FIG. 2 is a diagram that shows the implementation of the method according to the exemplary embodiments of the present invention.

FIG. 2 shows the washing machine 201 with the washing drum 202. It is symbolically indicated that the quantities temperature T, pressure P and water amount W are measured (Step 203) via the sensors 103, 104, 105 shown in FIG. 1. In a further step (Step 204), the measured quantities temperature T, pressure P and water amount W are grouped in the above-described way to form training data vectors 108 or, respectively, application vectors 107. The training data vectors 108 or, respectively, the application vectors 107 are also respectively provided with a time particularly 205 which indicates the point-in- time at which the quantities of temperature T, pressure P and water amount W were measured in the washing machine 201.

Since the quantities temperature T, pressure P and water amount W are not necessarily measured at constant time intervals from one another, the quantity pressure P (symbolized by block 206 in FIG. 2) as well as, the quantity temperature T (symbolized by block 207 in FIG. 2) are supplemented in a further method step (Step 208) to the effect that a respective quantity temperature T, pressure P and water amount W is present for an employment of the training data vectors 108 and the application vectors 107 in the filtering by a discrete digital filter at all points-in-time of a predetermined time sequence of equidistant intervals from one another, whereby the equidistant time interval $T_{period}$ is freely prescribable. Quantities temperature T, pressure P and water amount W not present in the measured quantities temperature T, pressure P and water amount W are artificially generated at the respective point-in-time by interpolation of neighboring, existing quantities of temperature T, pressure P and water amount W.

Two time rows are formed in this way. A first time row for the quantity pressure P forms a first vector $\underline{P}_r$ that is formed according to the following rule:

$$\underline{P}_r = [P(t - \text{order} \cdot T_{period}), \ldots, P(t - T_{period})\ P(T)], \tag{12}$$

"whereby uorder" refers to a plurality of chronologically past quantities taken into consideration in the framework of the filtering.

A second time row is formed for the quantity temperature T and is combined in a second vector $\underline{T}_r$ according to the following rule:

$$\underline{T}_r = [T(t - \mathbf{29} \cdot T_{period}), T(t - T_{period}), T(t)]. \tag{13}$$

The first vector $\underline{P}_r$ and the second vector $\underline{T}_r$ form an input quantity 209 for a pre-processing (Step 210) wherein, first, a digital filtering occurs and second, a smoothing of the curve of the input quantities 209 ensues.

In the pre-processing stage (Step 210), a first derivation quantity $$\frac{\partial P_f}{\partial t}$$

for a filtered quantity pressure $P_f$ is formed by formation of the partial derivation of the filtered quantity pressure $P_f$ after the time t, and a second derivation quantity $$\frac{\partial P_f}{\partial T}$$

of the filtered quantity pressure $P_f$ is formed by partial derivations of the filtered quantity pressure $P_f$ according to the temperature T. The filtered quantity pressure $P_f$, the first derivation quantity $$\frac{\partial P_f}{\partial t}$$

as well as the second derivation quantity $$\frac{\partial P_f}{\partial T}$$

and a water amount W symbolized by block 211 form a data vecto $$\left[P_0 \frac{\partial P_f}{\partial T}, \frac{\partial P_f}{\partial T}, w\right]$$

212 that is employed thereafter.

The quantities for the training data vectors 108 are determined for a complete heating phase of a washing phase. What is to be understood by a washing phase is a time span that begins with the admission of water into the washing machine 201 and ends with the discharge of the water from the washing machine 201. Such a washing phase usually lasts approximately 40 minutes. What is to be understood by the heating phase is a time span during the washing phase wherein the temperature prevailing in the washing machine 201 is raised. A fuzzy clustering method is implemented for the identified data vectors 108, the cluster centers $v_i$ of forming clusters of the training data vectors 108 being described therewith. The determination of the cluster centers $V_i$ ensues for two clusters, whereby a first cluster indicates that the foam formation is to be anticipated for a data vector $x_k$ that is located within this cluster, and a second cluster describes that no foam formation in the washing machine 201 is to be anticipated for a data vector $x_k$ that is located in the second cluster.

$$\underline{v}_i = \frac{\sum_{k=1}^{n} u_{ik}^m \cdot \underline{x}_k}{\sum_{k=1}^{n} u_{ik}^m} \tag{6}$$

whereby $x_k$ respectively references a training data vector 108, $-u_{ik}$ references an affiliation value that is determined according to the following rule:

The cluster centers $v_i$ are formed according to the following rule:

$$u_{ik} = \frac{1}{\sum_{j=1}^{c} \left(\frac{d_{ik}}{d_{jk}}\right)^{\frac{2}{m-1}}},$$

with $$d_{ik} = \|X_k - V_i\|_A = \sqrt{(X_k - V_i)^T \cdot A \cdot (X_k - V_i)}. \quad (4)$$

The exponent m is selected as the number 0.91.

The determination of the cluster centers $v_i$. and of the affiliation values $u_{ik}$ ensues in alternation until the change of a cluster center $v_i$ between two iterations is below a predetermined threshold. The result are the cluster centers $v_i$, i.e. the first cluster center and the second cluster center. A respective fuzzy clustering method according to the above-described procedure is implemented for each time interval into which the heating phase is subdivided, whereby the time interval exhibits a prescribable size, so that the two cluster centers $v_i$ are respectively identified for each time interval. The cluster centers $v_i$, are stored in the memory 106.

A time index is respectively allocated to the cluster centers $v_i$, this indicating during which time interval the quantities had been identified on the basis whereof the determination of the cluster centers $v_i$ ensued. In this way, a respective set of fuzzy clusters has been identified for the time intervals, a classification of measured quantities as application vectors 107 being possible according to the method illustrated in FIG. 2 upon application thereof.

In the application phase, the heating particular 213 is formed in a heating phase during the washing process in the washing machine 201. For each data vector $x_k$ 212, which, of course, had been identified at a respectively specific time, the time at which the respective data vector 212 was measured is made available as time index 214 and a time particular 215 is determined that indicates how much time has elapsed proceeding from the point-in-time at which the data vector 212 was measured since the beginning of the heating phase within the application phase. When the time particular 215 is identified, then the set of cluster centers $v_i$ is identified for the corresponding time particular 215, these referring to quantities that had been identified within this time interval (Step 216).

The coordinates of the cluster centers $v_i$ of the first cluster and of the second cluster that were determined within the respective time interval are read out from the memory 106 (Step 217), and the cluster centers $v_i$ are employed in order to determined fuzzy affiliation values u*k* for the data vectors $x_k$ 212 (Step 218).

The determination of the fuzzy affiliation values $u_{ik}$ to the data vector $x_k$ 212 ensues according to the following rule:

$$u_{ik} = \frac{1}{\sum_{j=1}^{c} \left(\frac{d_{ik}}{d_{jk}}\right)^{\frac{2}{m-1}}}, \quad (5)$$

with $$d_{ik} = \|X_k - V_i\|_A = \sqrt{(X_k - V_i)^T \cdot A \cdot (X_k - V_i)}. \quad (4)$$

The identified fuzzy affiliation values u*ik* are stored (Step 219) and, upon employment of the fuzzy affiliation values uk, a probability 221 is determined in a further step (Step 220) for the data vector $x_k$ 212, namely a probability that a formation of foam can be anticipated in the washing machine 201 for the point-in-time at which the quantities of the data vector $x_k$ 212 had been measured.

The probability 221 is formed according to the following rule:

$$p(foam, I_i) = \frac{\alpha \cdot \sum u(I_i)}{\alpha \cdot \sum u(I_i) + \sum v(I_i)}, \quad (14)$$

whereby

–$\Sigma u\ (I_i)$ indicates a plurality of data vectors $x_k$ that have been determined during the time interval $I_i$ $$I_i = \left[\frac{(i-1)}{100}; \frac{i}{100}\right] \quad (15)$$

and for which a determination was made that, proceeding from the data vector $x_k$, a foam formation is to be anticipated;

–$\Sigma v\ (I_i)$ references a plurality of data vectors $x_k$ that have been identified during the time interval $I_i$ and for which it was found that, proceeding from the data vectors $x_{k1}$ no foam formation is to be anticipated; and $\alpha$ references normalization factor that is formed according to the following rule:

$$\alpha = \frac{\text{Plurality Of Training Vectors Identified With "no foam"}}{\text{Plurality Of Training Vectors Identified With "foam"}}.$$

All data vectors $x_k$ that contain quantities that have been measured during this time interval $I_i$ are related to a time interval $I_i$. The fuzzy affiliation values $u_{ik}$ are determined in the above-described way.

Proceeding from the cluster centers $v_i$ determined for the time interval $I_i$, a classification threshold is prescribed, whereby a data vector $x_k$ is classified to the effect that a foam formation is to be anticipated in the washing machine 201 for the point-in-time that the data vector $x_k$ represents when the fuzzy affiliation values $u_{ik}$ lie above the classification threshold. When the fuzzy affiliation values $U_{ik}$ lie below the classification threshold, then the data vector $v_k$ is classified to the affect that no foam formation is to be anticipated in the washing machine 201 for the point-in-time to which the data vector $x_k$ refers. The probability has thus been determined as to whether a foam formation is to be anticipated in a time interval $I_i$ in which a measurement of the above-described quantities occurred in the washing machine 201.

When the probability is higher than a predetermined threshold, then a controlling intervention is made in the washing process on the basis of the following measures. The control is that additional water is supplied to the washing machine 201. Further, the temperature T in the washing machine 201 can be reduced or the cycle with which a changing speed and/or rotational direction of a washing drum 102, 202 rotating in the washing machine can be varied. The washing machine 201 can also have a de-foaming material supplied to it for reducing the foam formation.

Figure 3:
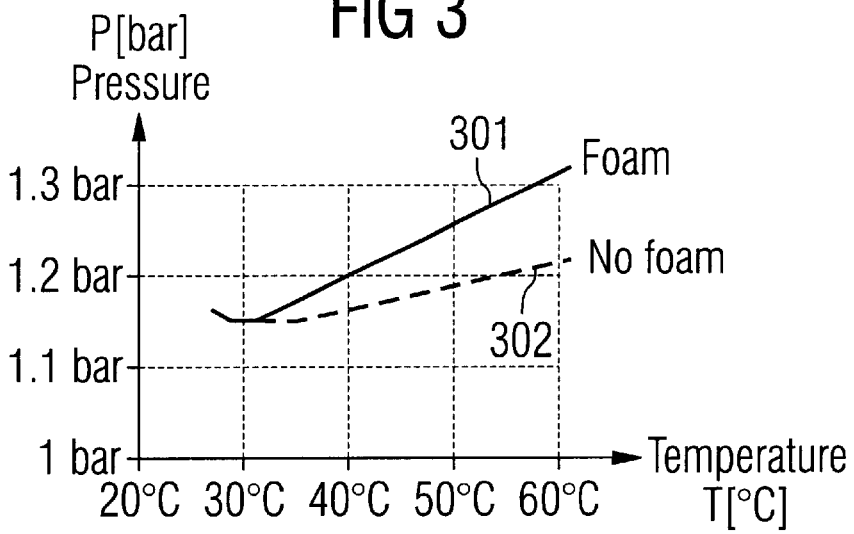
FIG. 3 a diagram wherein the dependency of the pressure in the washing machine on the temperature in the washing machine is shown for the two cases where foam or, respectively, no foam is present.

FIG. 3 shows a diagram that depicts an exemplary embodiment of the present invention. The pressure P in the washing machine 201 is entered as a function of a temperature T. When a foam formation occurs, it has been shown that a first curve 301 exhibits a substantially greater slope then a second curve 302 that describes the case wherein no foam is formed in the washing machine 201. The fuzzy clustering method respectively determines a cluster for describing the slope of the respective function for a time interval and utilizes this for classification.

Figure 4:
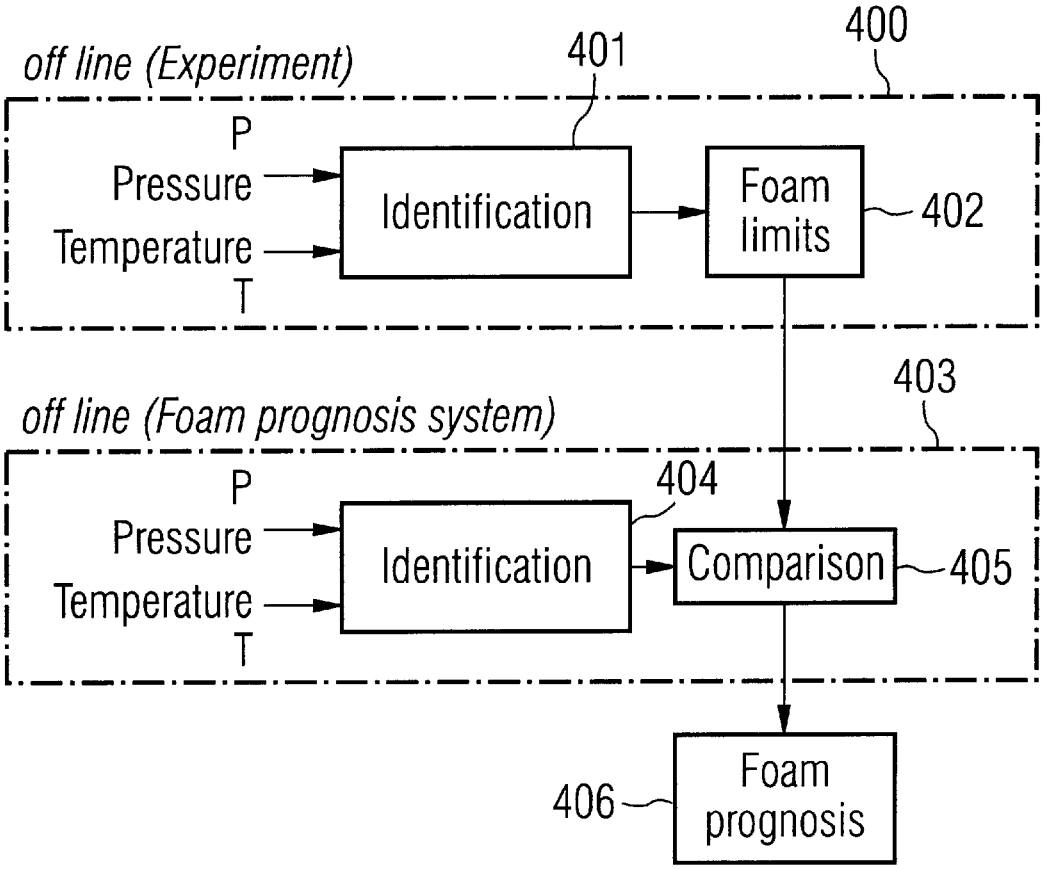
FIG. 4 is a block diagram with reference whereto the exemplary embodiment of the present invention is shown in an overview.

For illustration, FIG. 4 again shows the principle on which the above- described exemplary embodiment is based. In a first phase, the training phase 400, a determination of the cluster centers $v_i$ is implemented (Step 401) off-line for a test of the washing process using the measured quantities pressure P, temperature T and water amount W. The determination of the cluster centers $v_i$ ensues in the above-described way for the respective time intervals into which the washing phase or, respectively, the heating phase is divided. Proceeding from the formation of the cluster centers $v_i$, classification thresholds 402 (also referred to as foaming limits) are identified for the respective time intervals.

In a second phase, the application phase 403, the quantities pressure P, temperature T and water amount W are again identified, and the determination of the cluster centers $v_i$ as well as the determination of the fuzzy affiliation values $u_{ik}$ (Step 404) ensue in the above-described way. In a comparison step (Step 405), the fuzzy affiliation values are compared to the classification threshold 402, and the determination of a classification value 406 ensues, i.e. the above-described probability, this indicating whether a foam formation is to be anticipated or not.

The invention is not limited to the particular details of the method and apparatus depicted and other modifications and applications are contemplated. Certain other changes may be made in the above described method and apparatus without departing from the true spirit and scope of the invention herein involved. It is intended, therefore, that the subject matter in the above depiction shall be interpreted as illustrative and not in a limiting sense.

What is claimed is:

1. A method for computer-assisted determination of clusters for recognizing foam formation in a washing machine, comprising the steps of:

measuring a set of quantities during a washing process, the set of quantities having at least the quantities of a pressure in the washing machine, a temperature in the washing machine, an amount of water in the washing machine;

forming training data vectors from the measured quantities; and identifying, dependent on the training data vectors, clusters which indicate if a foam formation is to be anticipated for a set of measured quantities.

2. The method according to claim 1, wherein the method further comprises utilizing a fuzzy clustering method for determining the clusters.

3. The method according to claim 1, wherein the method further comprises using the clusters for recognizing foam formation in a washing machine.

4. A method for recognizing foam formation in a washing machine, comprising the steps of:

measuring a set of quantities during a washing process, the set of quantities having at least the quantities of a pressure in the washing machine, a temperature in the washing machine, an amount of water in the washing machine;

forming application vectors from the measured quantities;

determining for the application vectors fuzzy affiliation values of the application vectors for predetermined clusters; and recognizing a foam formation as a function of the fuzzy affiliation values.

5. The method according to claim 4, wherein the clusters indicate if a foam formation is to be anticipated for a set of measured quantities.

6. The method according to claim 4, wherein the method further comprises using a fuzzy clustering method for determining the clusters.

7. The method according to claim 4, wherein the method further comprises a regulating the foam formation in the washing machine dependent on a recognition result of the foam formation.

8. The method according to claim 7, wherein, when foam formation is recognized, the regulation ensues such that at least one of the following actions is implemented:

water is supplied to the washing machine;

a temperature in the washing machine is lowered;

a cycle with which at least one of a changing speed and a rotational direction of a washing drum turning in the washing machine is varied; and a de-foaming material is supplied to the washing machine.

9. An arrangement for determining clusters for recognizing foam formation in a washing machine, comprising:

a washing machine having a processor and the processor being configured such that during a washing process a pressure in the washing machine is measured, a temperature in the washing machine is measured, an amount of water in the washing machine is measured, the measured pressure, temperature and amount of water being measured quantities; and the processor also being configured such that training data vectors are formed from the measured quantities, and dependent on the training data vectors, clusters are identified that indicated if a foam formation is to be anticipated for a set of measured quantities.

10. The arrangement according to claim 9, wherein the arrangement further comprises at least one sensor for measuring the quantities and a memory for storing the measured quantities.

11. The arrangement according to claim 9, wherein the processor is configured such that a fuzzy clustering method is used for determining the clusters.

12. The arrangement according to claim 9, wherein the processor is also configured such that the foam formation is regulated based on the identified clusters.

13. An arrangement for recognizing foam formation in a washing machine, comprising:

a processor that is configured such that the following quantities are measured during a washing process; a pressure in the washing machine, a temperature in the washing machine, an amount of water in the washing machine;

the process also being configured such that application vectors are formed from the measured quantity;

the processor also being configured such that fuzzy affiliation values of the application vectors for predetermined clusters are determined for the application vectors; and the processor also being configured such that a foam formation is recognized dependent on the fuzzy affiliation values.

14. The arrangement according to claim 13, wherein the arrangement further comprises at least one sensor for measuring the quantities, and a memory for storing the measured quantities.

15. The arrangement according to claim 13, wherein the processor is also configured such that the clusters indicate if a foam formation is to be anticipated for a set of me asured quantities.

16. The arrangement according to claim 13, wherein the processor is also configured such that a fuzzy clustering method is used for determination of the clusters.

17. The arrangement according to claim 13, wherein the arrangement further comprises a control unit with which, dependent on a recognition result of the foam formation, a regulation ensues for regulating the foam formation in the washing machine.

18. The arrangement according to claim 17, wherein the control unit is configured such that, when foam formation is recognized, at least one of the following actions is implemented:

water is supplied to the washing machine;

the temperature in the washing machine is lowered;

a cycle with which at least one of a changing speed and a rotational direction of a washing drum rotating in the washing machine is varied; and a de-foaming material is supplied to the washing machine.

* * * * *